US009980872B2

(12) United States Patent
Villalobos

(10) Patent No.: US 9,980,872 B2
(45) Date of Patent: May 29, 2018

(54) SUSPENSION SYSTEM

(71) Applicant: Mario Villalobos, Marble, CO (US)

(72) Inventor: Mario Villalobos, Marble, CO (US)

( * ) Notice: Subject to any disclaimer, the term of this patent is extended or adjusted under 35 U.S.C. 154(b) by 0 days. days.

(21) Appl. No.: 15/048,825

(22) Filed: Feb. 19, 2016

(65) Prior Publication Data

US 2016/0243390 A1 Aug. 25, 2016

Related U.S. Application Data

(60) Provisional application No. 62/119,336, filed on Feb. 23, 2015.

(51) Int. Cl.

| | |
|---|---|
| ***A63B 21/068*** | (2006.01) |
| ***A63B 21/00*** | (2006.01) |
| ***A63B 26/00*** | (2006.01) |
| ***A61H 1/02*** | (2006.01) |
| ***A63B 23/12*** | (2006.01) |

(52) U.S. Cl.

CPC ..... *A61H 1/0292* (2013.01); *A61H 1/0229* (2013.01); *A63B 21/068* (2013.01); *A63B 23/1236* (2013.01); *A61H 2201/1253* (2013.01); *A61H 2201/164* (2013.01); *A61H 2201/1628* (2013.01); *A61H 2201/1635* (2013.01)

(58) Field of Classification Search

CPC ..... A61H 1/0292; A61H 1/0229; A61H 2201/164; A61H 2201/1628; A61H 2201/1635; A61H 2201/1253; A61H 2201/163; A61H 3/008; A63B 1/00; A63B 3/00; A63B 7/00; A63B 7/02; A63B 21/40; A63B 21/4023; A63B 21/068; A63B 23/12; A63B 23/1209; A63B 23/1227; A63B 23/1236; A63B 23/1218; A63B 69/24; A63B 69/26; A63B 21/0407

See application file for complete search history.

(56) References Cited

U.S. PATENT DOCUMENTS

| | | | | |
|---|---|---|---|---|
| 2,819,755 A * | 1/1958 | Berger | A61H 3/008 | 182/181.1 |
| 3,379,434 A * | 4/1968 | Guzaldo | A63B 21/0005 | 482/139 |
| 4,502,682 A * | 3/1985 | Miller | A61H 1/0218 | 482/144 |
| 4,531,514 A * | 7/1985 | McDonald | A61H 1/0218 | 482/144 |
| 4,753,438 A * | 6/1988 | Paris | A61H 1/0218 | 482/144 |

(Continued)

OTHER PUBLICATIONS

U.S. Appl. No. 62/119,336, filed Feb. 22, 2015.

*Primary Examiner* — Nyca T Nguyen

(74) *Attorney, Agent, or Firm* — Craig R. Miles; CR Miles P.C.

(57) ABSTRACT

A suspension system, and methods of making and using such a suspension system, whereby the suspension system includes a first support including a pair of first upright members disposed in spaced apart relation; a second support including a pair of second upright members disposed in spaced apart relation; a transverse member disposed between the first and second supports; a grippable element disposed between the first upright members; and a suspension element disposed between the second upright members.

17 Claims, 9 Drawing Sheets

(56) References Cited

U.S. PATENT DOCUMENTS

| | | | | | |
|---|---|---|---|---|---|
| 4,838,250 | A * | 6/1989 | Angelo | A63B 23/0233 | 482/142 |
| 5,162,029 | A * | 11/1992 | Gerard | A63B 22/02 | 198/861.1 |
| 5,290,209 | A * | 3/1994 | Wilkinson | A63B 21/00047 | 482/121 |
| 5,876,311 | A * | 3/1999 | Coates | A47C 3/0252 | 297/274 |
| 6,347,603 | B1 * | 2/2002 | Felger | A01K 15/027 | 119/700 |
| 6,422,982 | B1 * | 7/2002 | Retel | A61H 1/0218 | 482/143 |
| 6,578,594 | B1 * | 6/2003 | Bowen | A61H 3/008 | 135/67 |
| 6,890,288 | B2 * | 5/2005 | Bingham | A47D 13/046 | 482/69 |
| 7,255,666 | B2 * | 8/2007 | Cardenas | A61H 1/0229 | 482/143 |
| 7,534,200 | B1 * | 5/2009 | Martinez | A63B 21/00047 | 482/142 |
| 2005/0003938 | A1 * | 1/2005 | Henderson | A63B 21/068 | 482/143 |
| 2005/0255971 | A1 * | 11/2005 | Solomon | A61H 1/0229 | 482/54 |
| 2008/0096744 | A1 * | 4/2008 | Perry, Jr. | A61H 1/0218 | 482/144 |
| 2008/0254957 | A1 * | 10/2008 | Hazan | A63B 21/0552 | 482/140 |
| 2012/0138113 | A1 * | 6/2012 | Spinabella | A47B 97/00 | 135/66 |
| 2012/0142506 | A1 * | 6/2012 | Hetrick | A63B 23/1218 | 482/142 |
| 2013/0324383 | A1 * | 12/2013 | Rogers | A63B 26/00 | 482/142 |

* cited by examiner

SUSPENSION SYSTEM

This U.S. Non-Provisional Patent Application claims the benefit of U.S. Provisional Patent Application No. 62/119,336, filed Feb. 22, 2015, hereby incorporated by reference herein.

I. SUMMARY OF THE INVENTION

A broad object of a particular embodiment of the invention can be to provide a suspension system, and methods of making and using such a suspension system, whereby the suspension system includes a first support comprising a pair of first upright members disposed in spaced apart relation; a second support comprising a pair of second upright members disposed in spaced apart relation; a transverse member disposed between the first and second supports; a grippable element disposed between the first upright members; and a suspension element disposed between the second upright members.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1:
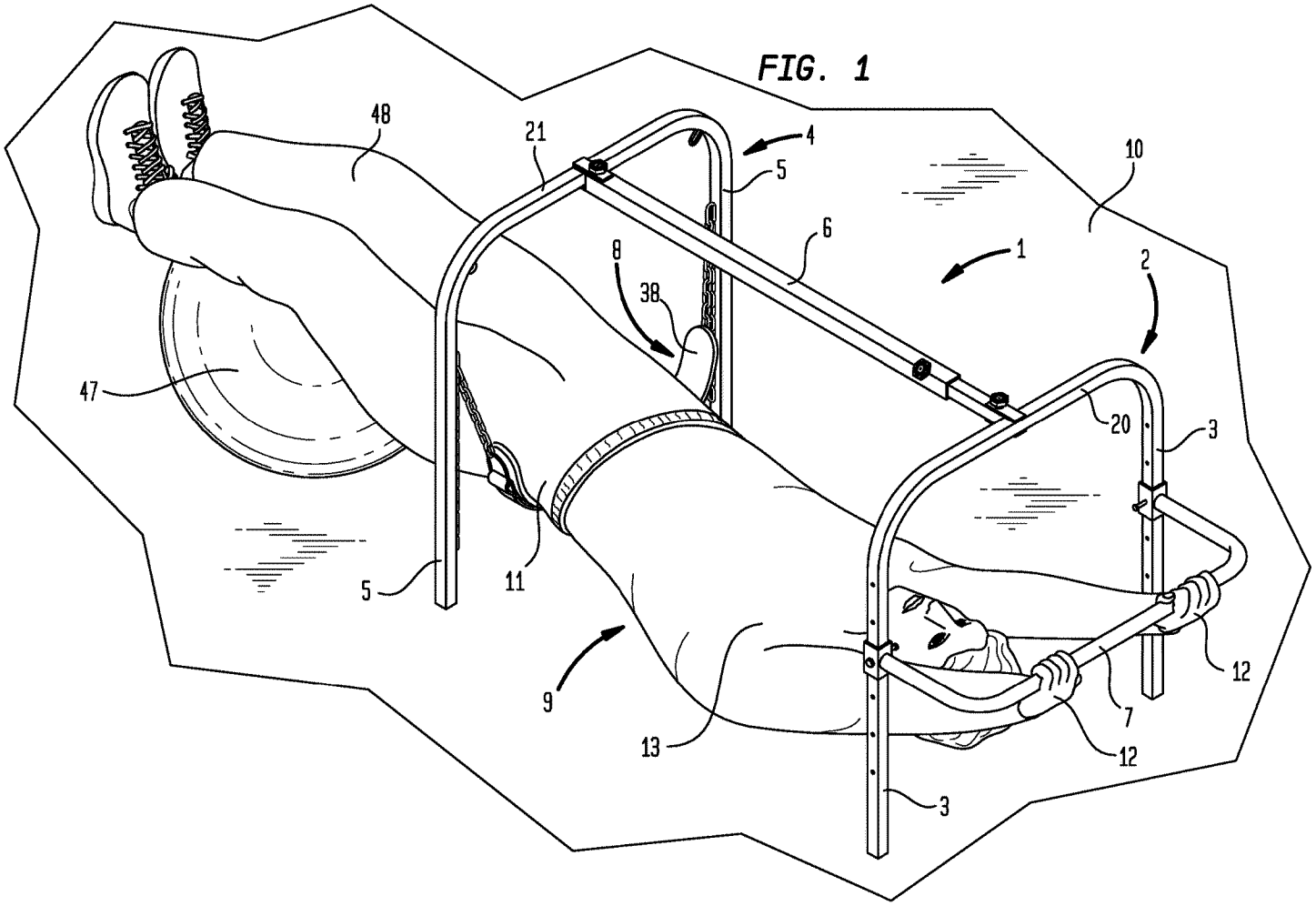
FIG. 1 is an illustration of a method of using a particular embodiment of the inventive suspension system to generate forces on a portion of a spine of a user, which may be effective to alleviate one or more disorder symptoms or to treat one or more disorders.

Now referring primarily to FIG. 1, which illustrates a method of using a particular embodiment of a suspension system (1) including a first support (2) comprising a pair of first upright members (3) disposed in spaced apart relation; a second support (4) comprising a pair of second upright members (5) disposed in spaced apart relation; a transverse member (6) disposed between the first and second supports (2)(4); a grippable element (7) disposed between the first upright members (3); and a suspension element (8) disposed between the second upright members (5). The method by which a user (9) can use the suspension system (1) includes engaging the first and second supports (2)(4) with a support surface (10) to support the grippable element (7) and the suspension element (8) above the support surface (10);

engaging a lower torso portion (11) of the user (9) with the suspension element (8) to suspend the lower torso portion (11) above the support surface (10); gripping the grippable element (7) via a hand portion (12) of the user (9); and drawing an upper torso portion (13) of the user (9) in opposed relation to the lower torso portion (11). As to particular embodiments, drawing the upper torso portion (13) in opposed relation to the lower torso portion (11) can generate forces on a portion of a spine of the user (9), which may be effective to alleviate one or more disorder symptoms or to treat one or more disorders.

The term "torso" for the purposes of the present invention means the trunk of a human body, the trunk excluding the head, neck, and limbs. The torso can be divided into an upper torso portion (13) and a lower torso portion (11), the upper torso portion (13) extending from about the bustline upward and the lower torso portion (11) extending from about the bustline downward.

The term "symptom" for the purposes of the present invention means any discomfort or combination of discomforts associated with a disorder. Without limiting the breadth of the foregoing, symptoms can include: acute pain or chronic pain of varying characteristics including but not limited to throbbing, tearing, sharp, dull, deep, lancinating, burning, aching, stabbing, intense, lightning-like, sense of swelling, or tingling; or the like; or combinations thereof.

The term "disorder" for the purposes of the present invention means a physical or mental condition which may not be normal or healthy. Without limiting the breadth of the foregoing, a disorder having one or more associated symptoms which can be alleviated by use of the suspension system (1) or which can be treated by use of the suspension system (1) can include: fractures, sprains, muscle or ligament strain, bulging disks, ruptured disks, herniated disks, arthritis, skeletal irregularities, osteoporosis, scoliosis, osteomyelitis, or the like, or combinations thereof.

Now referring primarily to FIG. 2A through FIG. 8, the suspension system (1) includes a first support (2) comprising a pair of first upright members (3) disposed in spaced apart relation, and a second support (4) comprising a pair of second upright members (5) disposed in spaced apart relation, whereby the first and second supports (2)(4) dispose in spaced apart relation.

The first and second upright members (3)(5) can be formed from any of a numerous and wide variety of materials having any of a numerous and wide variety of configurations capable of providing a portion of a supportive frame of the suspension system (1). As a non-limiting example, the first and second upright members (3)(5) can be formed from metal and can be configured as elongate members, such as rods or tubes, which may or may not be linear, depending upon the application.

As to particular embodiments, the first upright members (3) can dispose in generally parallel spaced apart relation, and the second upright members (5) can dispose in generally parallel spaced apart relation (as shown in the examples of the Figures).

As to other particular embodiments, the first upright members (3) can dispose in angled spaced apart relation, and/or the second upright members (5) can dispose in angled spaced apart relation (not shown).

Figure 3:
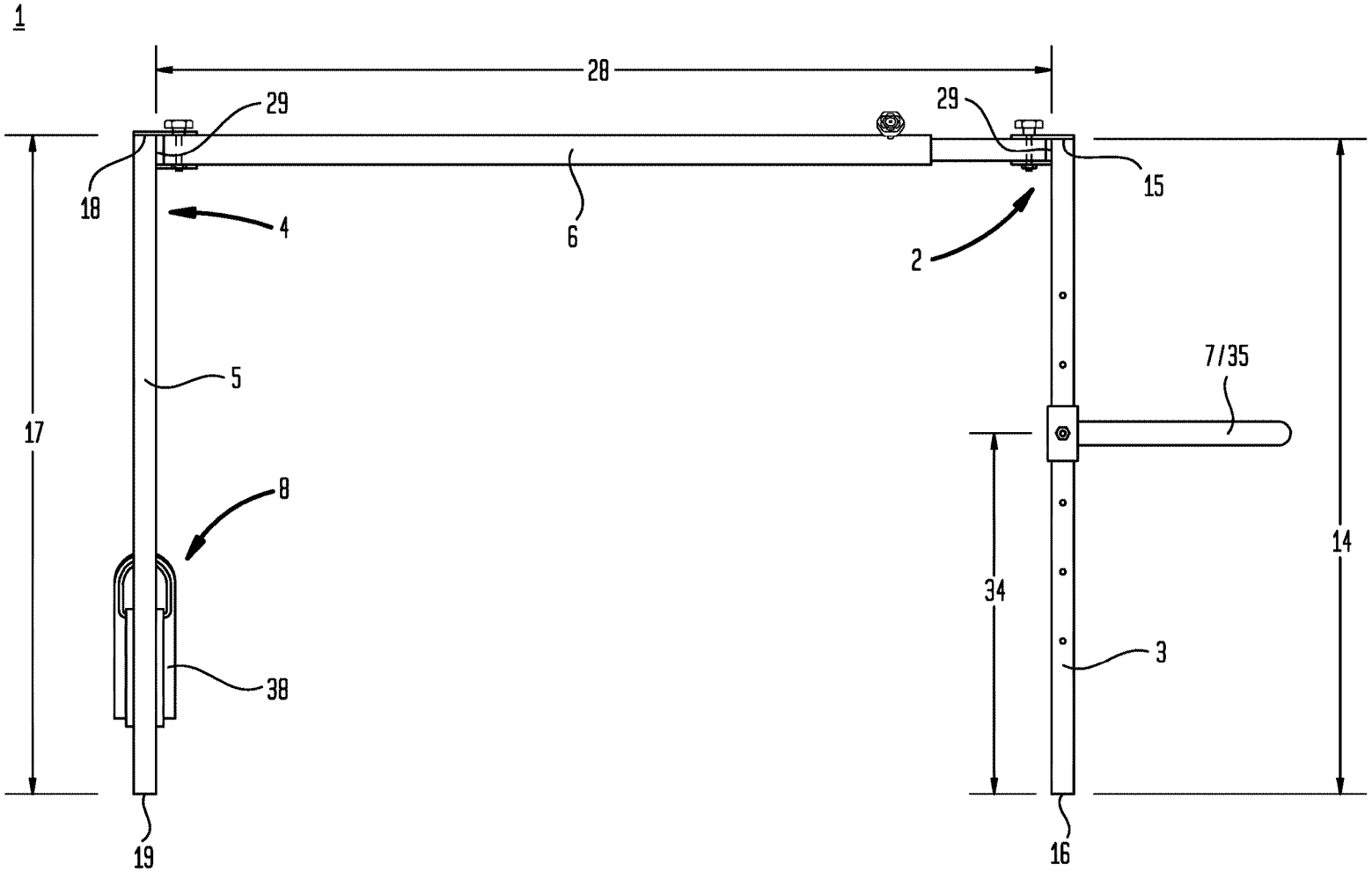
FIG. 3 is a first side view of the particular embodiment of the inventive suspension system shown in FIG. 2A.
Figure 4:
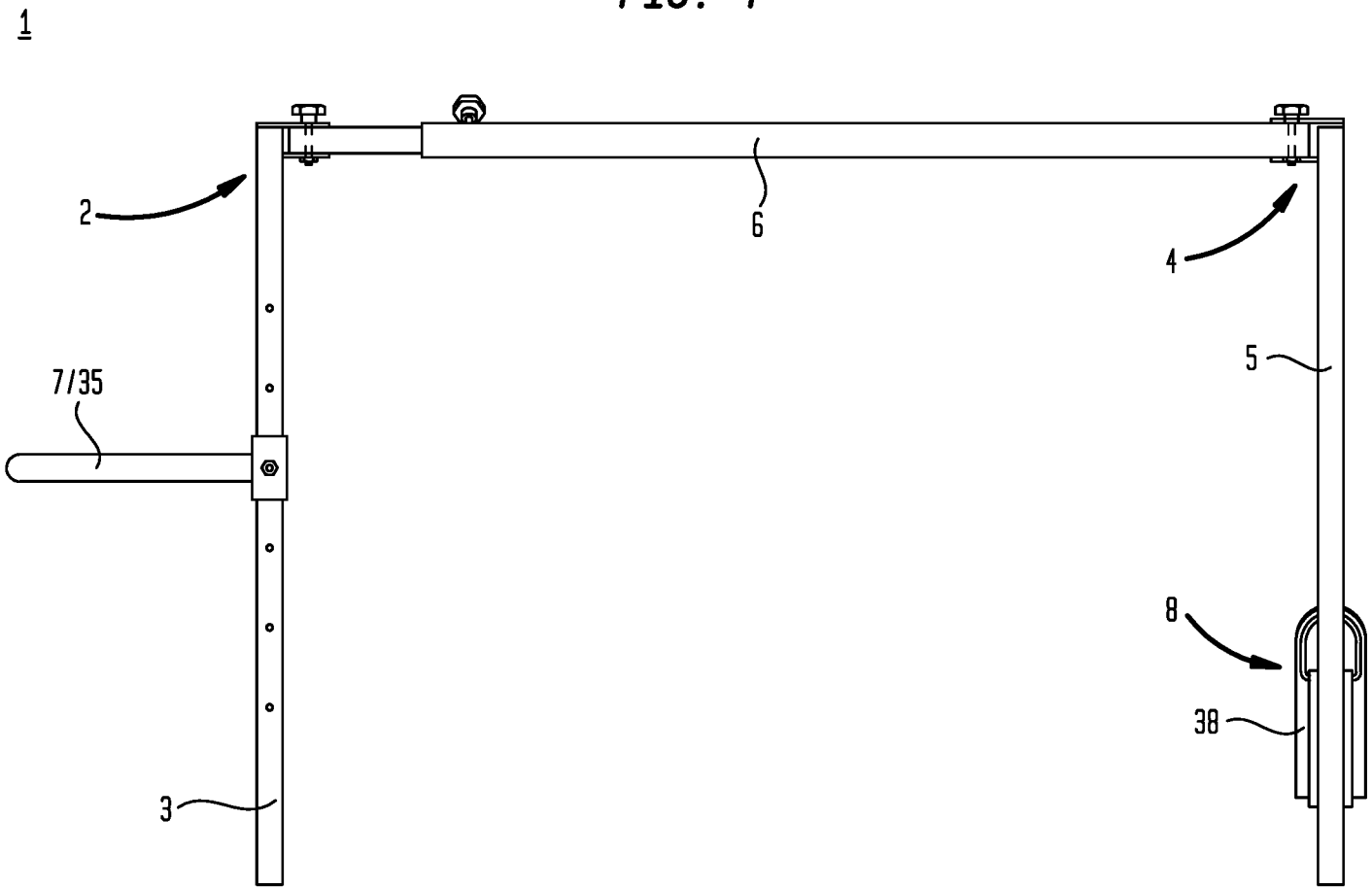
FIG. 4 is a second side view of the particular embodiment of the inventive suspension system shown in FIG. 2A.

Now referring primarily to FIG. 3, each of the first upright members (3) can have a first upright member length (14) disposed between first upright member upper and lower ends (15)(16), and each of the second upright members (5) can have a second upright member length (17) disposed between second upright member upper and lower ends (18)(19).

As to particular embodiments, the first and second upright member lengths (14)(17), which may be similar or dissimilar, can be in a range of between about 0.5 meters to about 1.5 meters, which may be a useful range of lengths for generating forces on a portion of a spine of a user (9) to alleviate one or more disorder symptoms or to treat one or more disorders. However the invention need not be so limited, as the first and second upright member lengths (14)(17) can be lesser than about 0.5 meters or greater than about 1.5 meters, depending upon the application.

As to particular embodiments, the first and second upright member lengths (14)(17) can be adjustable between lesser and greater lengths, which may be useful for accommodating a plurality of users (9) of varying dimensional relations or may be useful for transport, storage, or the like. For example, regarding the latter, adjusting the first and second upright member lengths (14)(17) towards lesser lengths may reduce the volume of space occupied by the suspension system (1).

Now referring primarily to FIG. 2A through FIG. 8, as to particular embodiments, the first support (2) can, but need not necessarily, further include a first crosspiece (20) disposed between the first upright members (3), and the second support (4) can, but need not necessarily, further include a second crosspiece (21) disposed between the second upright members (5), whereby the first and second crosspieces (20)(21) can be coupled, directly coupled, or connected to the corresponding first and second upright members (3)(5), depending upon the application.

The first and second crosspieces (20)(21) can be formed from any of a numerous and wide variety of materials having any of a numerous and wide variety of configurations capable of providing a portion of a supportive frame of the suspension system (1). As a non-limiting example, the first and second crosspieces (20)(21) can be formed from metal and can be configured as elongate members, such as rods or tubes, which may or may not be linear, depending upon the application.

Figure 5:
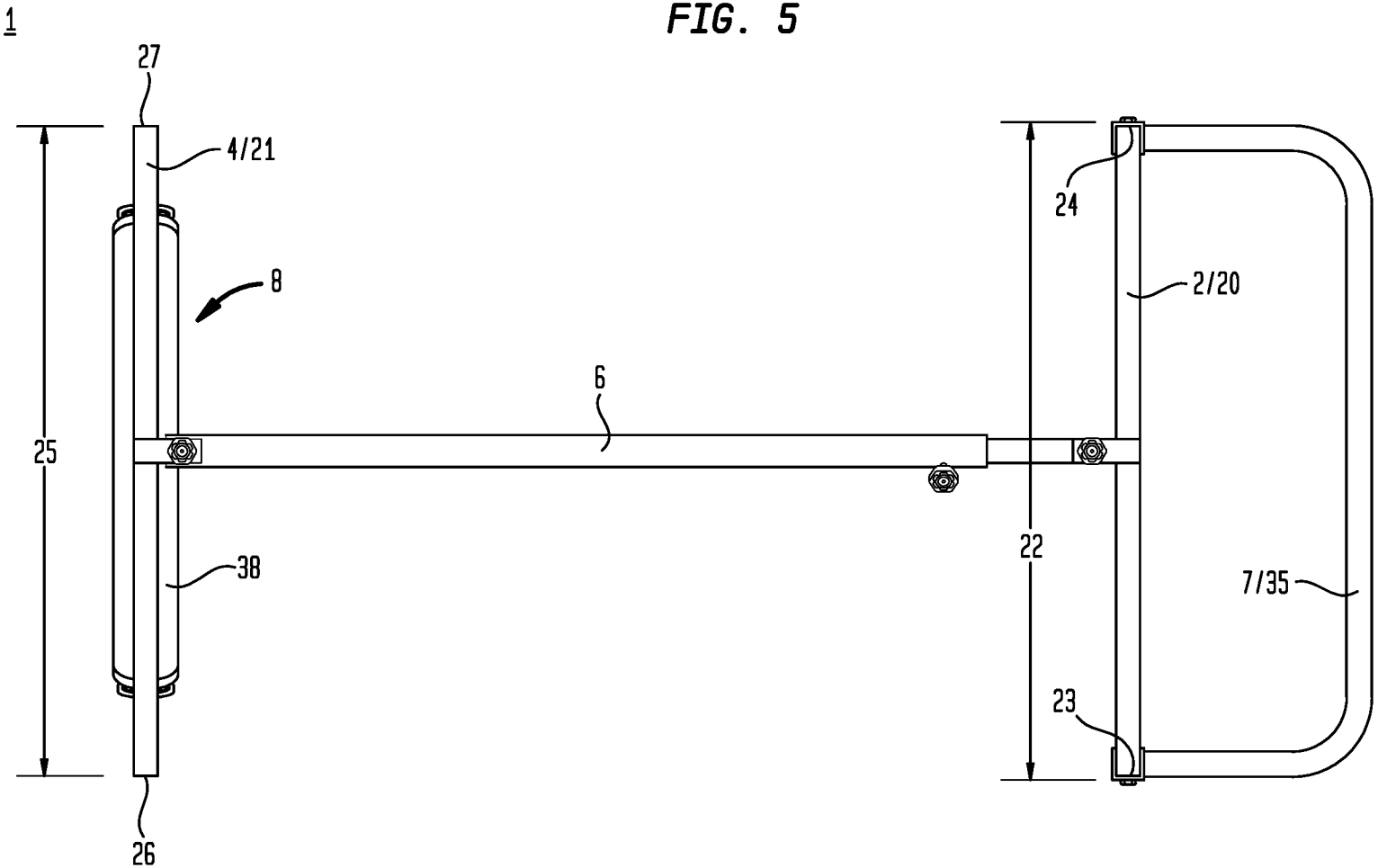
FIG. 5 is a top view of the particular embodiment of the inventive suspension system shown in FIG. 2A.
Figure 6:
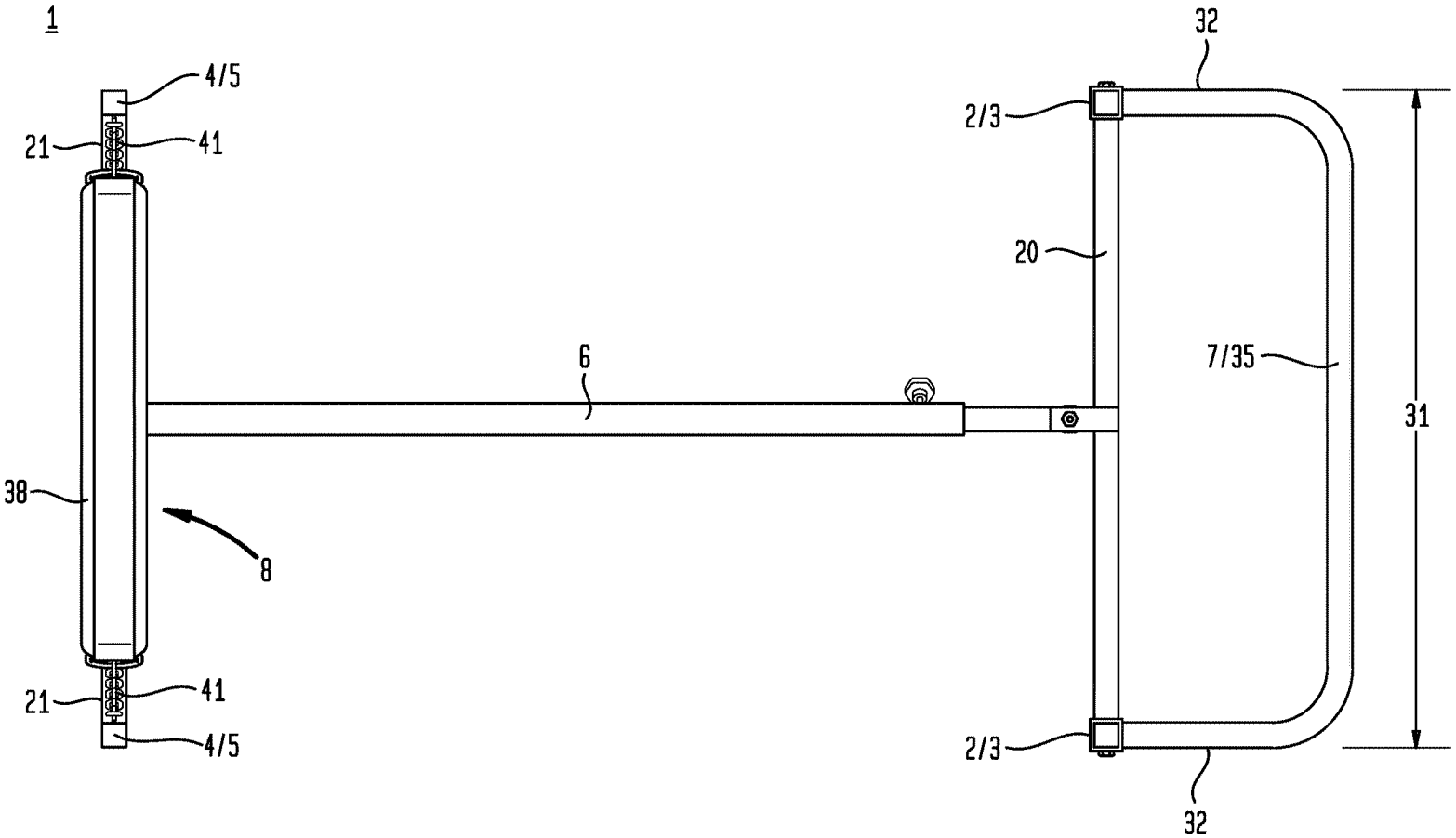
FIG. 6 is a bottom view of the particular embodiment of the inventive suspension system shown in FIG. 2A.

Now referring primarily to FIG. 5, the first crosspiece (20) can have a first crosspiece length (22) disposed between first crosspiece first and second ends (23)(24), and the second crosspiece (21) can have a second crosspiece length (25) disposed between second crosspiece first and second ends (26)(27).

As to particular embodiments, the first and second crosspiece lengths (22)(25), which may be similar or dissimilar, can be in a range of between about 0.5 meters to about 1.5 meters, which may be a useful range of lengths for generating forces on a portion of a spine of a user (9) to alleviate one or more disorder symptoms or to treat one or more disorders. However the invention need not be so limited, as the first and second crosspiece lengths (22)(25) can be lesser than about 0.5 meters or greater than about 1.5 meters, depending upon the application.

As to particular embodiments, the first and second crosspiece lengths (22)(25) can be adjustable between lesser and greater lengths, which may be useful for accommodating a plurality of users (9) of varying dimensional relations or may be useful for transport, storage, or the like. For example, regarding the latter, adjusting the first and second crosspiece lengths (22)(25) towards lesser lengths may reduce the volume of space occupied by the suspension system (1).

Now referring primarily to FIG. 2A through FIG. 8, as to particular embodiments having a first support (2) including a first crosspiece (20) disposed between a pair of first upright members (3), the first support (2) can be configured as a one-piece first support (2), whereby the first crosspiece (20) and the pair of first upright members (3) are formed as a continuous construct.

As to particular embodiments, the continuous construct which forms the one-piece first support (2) can be arcuate between the first crosspiece first end (23) and the corresponding first upright member upper end (15) and between the first crosspiece second end (24) and the corresponding other first upright member upper end (15).

Additionally, as to particular embodiments having a second support (4) including a second crosspiece (21) disposed between a pair of second upright members (5), the second support (4) can be configured as a one-piece second support (4), whereby the second crosspiece (21) and the pair of second upright members (5) are formed as a continuous construct.

As to particular embodiments, the continuous construct which forms the one-piece second support (4) can be arcuate between the second crosspiece first end (26) and the corresponding second upright member upper end (18) and between the second crosspiece second end (27) and the corresponding other second upright member upper end (18).

Again referring primarily to FIG. 2A through FIG. 8, the suspension system (1) further includes a transverse member (6) disposed between the first and second supports (2)(4), whereby the transverse member (6) can be coupled, directly coupled, or connected to the first and second supports (2)(4), depending upon the application.

The transverse member (6) can be formed from any of a numerous and wide variety of materials having any of a numerous and wide variety of configurations capable of providing a portion of a supportive frame of the suspension system (1). As a non-limiting example, the transverse member (6) can be formed from metal and can be configured as an elongate member, such as a rod or tube, which may or may not be linear, depending upon the application.

Now referring primarily to FIG. 3, the transverse member (6) can have a transverse member length (28) disposed between opposing transverse member ends (29). As to particular embodiments, the transverse member length (28) can be in a range of between about 0.5 meters to about 2 meters, which may be a useful range of lengths for generating forces on a portion of a spine of a user (9) to alleviate one or more disorder symptoms or to treat one or more disorders. However, the invention need not be so limited, as the transverse member length (28) can be lesser than about 0.5 meters or greater than about 2 meters, depending upon the application.

As to particular embodiments, the transverse member length (28) can be adjustable between a lesser and greater length (28), which may be useful for accommodating a plurality of users (9) of varying dimensional relations or may be useful for transport, storage, or the like. For example, regarding the latter, adjusting the transverse member length (28) towards a lesser length may reduce the volume of space occupied by the suspension system (1).

Now referring primarily to FIG. 2A through FIG. 8, as to particular embodiments, the transverse member (6) can be disposed between the first crosspiece (20) coupled between the first upright members (3) and the second crosspiece (21) coupled between the second upright members (5), whereby the transverse member (6) can be coupled, directly coupled, or connected to the first and second crosspieces (20)(21), depending upon the application.

Again referring primarily to FIG. 2 through FIG. 8, the suspension system (1) further includes a grippable element (7) disposed between the first upright members (3), whereby the grippable element (7) can be coupled, directly coupled, or connected to the first upright members (3), depending upon the application.

The grippable element (7) can be formed from any of a numerous and wide variety of materials having any of a numerous and wide variety of configurations capable of providing a grippable element (7) for a user (9) of the suspension system (1) and particularly, for a hand portion (12) of the user (9). As a non-limiting example, the grippable element (7) can be formed from metal and can be configured as an elongate member, such as a rod or tube, which may or may not be linear, depending upon the application.

Now referring primarily to FIG. 5, the grippable element (7) can have a grippable element length (31) disposed between opposing grippable element ends (32). As to particular embodiments, the grippable element length (31) can be in a range of between about 0.5 meters to about 2 meters, which may be a useful range of lengths for generating forces on a portion of a spine of a user (9) to alleviate one or more disorder symptoms or to treat one or more disorders. However, the invention need not be so limited, as the grippable element length (31) can be lesser than about 0.5 meters or greater than about 2 meters, depending upon the application.

As to particular embodiments, the grippable element length (31) can be adjustable between a lesser and greater length, which may be useful for accommodating a plurality of users (9) of varying dimensional relations or may be useful for transport, storage, or the like. For example, regarding the latter, adjusting the adjustable grippable element length (31) towards a lesser length may reduce the volume of space occupied by the suspension system (1).

As to particular embodiments, the grippable element length (31) can be generally coplanar with the pair of first upright members (3) between which the grippable element (7) disposes (not shown).

As to other particular embodiments, the grippable element length (31) can inwardly extend from the vertical plane defined by the pair of first upright members (3) between which the grippable element disposes (7) (not shown).

As to yet other particular embodiments, the grippable element length (31) can outwardly extend from the vertical plane defined by the pair of first upright members (3) between which the grippable element disposes (7) (as shown in the examples of the Figures).

Now referring primarily to FIG. 3, as to particular embodiments, the grippable element (7) can couple between the first upright members (3) to dispose the grippable element (7) a first distance (34) from the first upright members' lower ends (16) and correspondingly, from the support surface (10) which the first upright members (3) engage with.

As to particular embodiments, the grippable element (7) can adjustably couple between the first upright members (3) along the first upright members' lengths (14) to dispose the grippable element (7) a first distance (34) from the first upright members' lower ends (16) and correspondingly, from the support surface (10) which the first upright members (3) engage with. Accordingly, the first distance (34) can be adjustable between a lesser and greater distance, which may be useful for accommodating a plurality of users (9) of varying dimensional relations or for generating forces on a portion of a spine of a user (9) to alleviate one or more disorder symptoms or to treat one or more disorders.

For example, adjusting the first distance (34) towards a lesser distance can dispose the grippable element (7) a lesser distance from the first upright members' lower ends (16) and, correspondingly, a lesser distance from the support surface (10) which the first upright members (3) engage with, in relation to adjusting the first distance (34) towards a greater distance, which can dispose the grippable element (7) a greater distance from the first upright members' lower ends (16) and, correspondingly, a greater distance from the support surface (10) which the first upright members (3) engage with.

As an illustrative example, a particular embodiment of the suspension system (1) can have a grippable element (7) which adjustably couples between the first upright members (3) along the first upright members' lengths (14) to dispose the grippable element (7) at a first distance (34), which can be any of a plurality of discrete first distances (34) from the first upright members' lower ends (16) and correspondingly, from the support surface (10) which the first upright members (3) engage with, whereby five discrete first distances (34) are shown as a non-limiting example in the Figures.

Now referring primarily to FIG. 2A and FIG. 3 through FIG. 8, as to particular embodiments, the grippable element (7) can be configured as a continuous grippable element (35) which continuously extending between the first upright members (3).

Figure 2A:
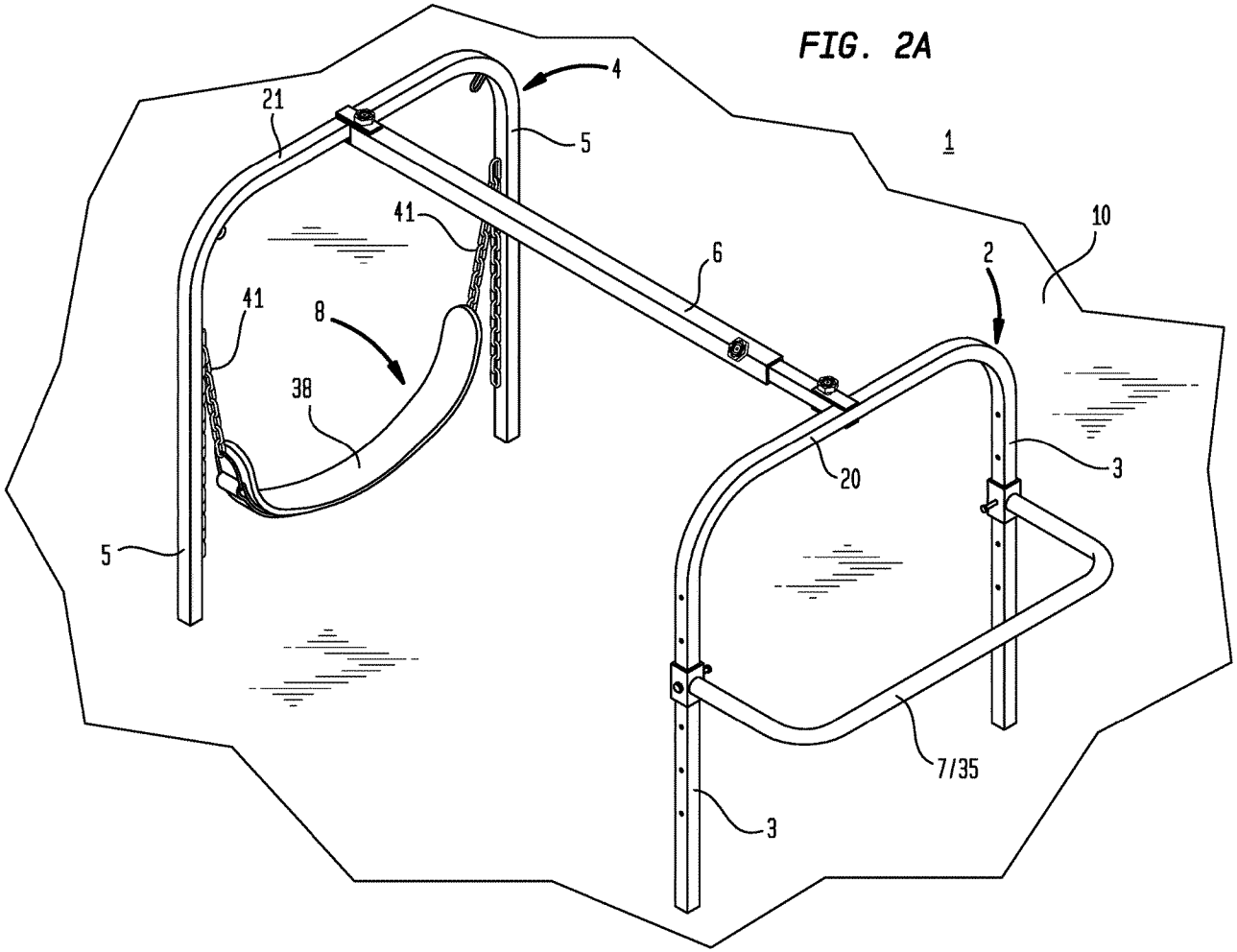
FIG. 2A is a perspective view of a particular embodiment of the inventive suspension system, whereby a grippable element is configured as a continuous grippable element which continuously extends between a pair of first upright members.
Figure 2B:
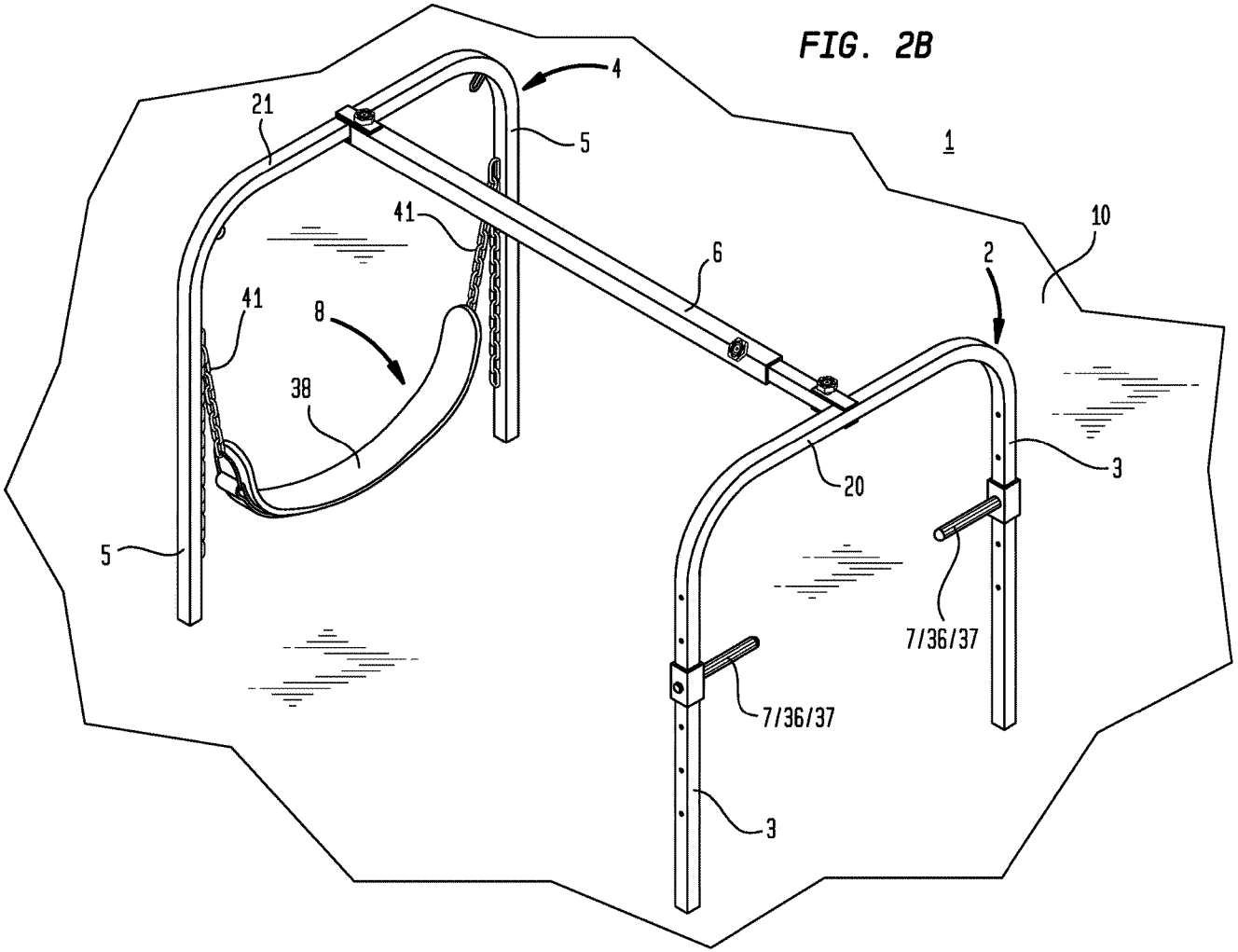
FIG. 2B is a perspective view of a particular embodiment of the inventive suspension system, whereby a grippable element is configured as a pair of discontinuous grippable elements, each inwardly extending from a first upright member.

Now referring primarily to FIG. 2B, as to other particular embodiments, the grippable element (7) can be configured as a pair of discontinuous grippable elements (36), whereby each discontinuous grippable element (36) inwardly extends from one of the first upright members (3). In this particular embodiment, each discontinuous grippable element (36) can be gripped by one of a pair of hand portions (12) of a user (9) when using the suspension system (1).

Again referring primarily to FIG. 2B, as to particular embodiments, the grippable element (7) can, but need not necessarily, further include a grippable external surface element (37), for example a plurality of recess elements and/or a plurality of raised elements, which can facilitate gripping of the grippable element (7) or can allow a hand portion (12) of a user (9) to maintain a grip on the grippable element (7) when using the suspension system (1).

Now referring primarily to FIG. 2A through FIG. 9, the suspension system (1) further includes a suspension element (8) disposed between the second upright members (5), whereby the suspension element (8) can be coupled, directly coupled, or connected to the second upright members (5), depending upon the application.

The suspension element (8) can be formed from any of a numerous and wide variety of materials having any of a numerous and wide variety of configurations capable of suspending a lower torso portion (11) of a user (9) above a support surface (10).

Again referring primarily to FIG. 2A through FIG. 9, the suspension element (8) can, but need not necessarily, include a flexible lower torso engagement portion (38), which can sufficiently flex to conformingly engage a lower torso portion (11) of a user (9) to suspend the lower torso portion (11) above a support surface (10).

The flexible lower torso engagement portion (38) can be formed from any of a numerous and wide variety of materials having any of a numerous and wide variety of configurations capable of sufficiently flexing to conformingly engage a lower torso portion (11) of a user (9) to suspend the lower torso portion (11) above a support surface (10). As non-limiting examples, the flexible lower torso engagement portion (38) can be formed from a flexible material, such as plastic, plastic-like material, rubber, rubber-like material, cotton, linen, polyester, leather, suede, vinyl, elastane, wool, rayon, viscose, or the like, or combinations thereof.

As to particular embodiments, a cushioning element can be coupled to the flexible lower torso engagement portion (38), whereby the cushioning element can compressingly engage a lower torso portion (11) of a user (9) (not shown). As an illustrative example, the cushioning element can be formed from a compressible material, such as batting, foam, rubber, fabric, or the like, or combinations thereof.

Figure 9:
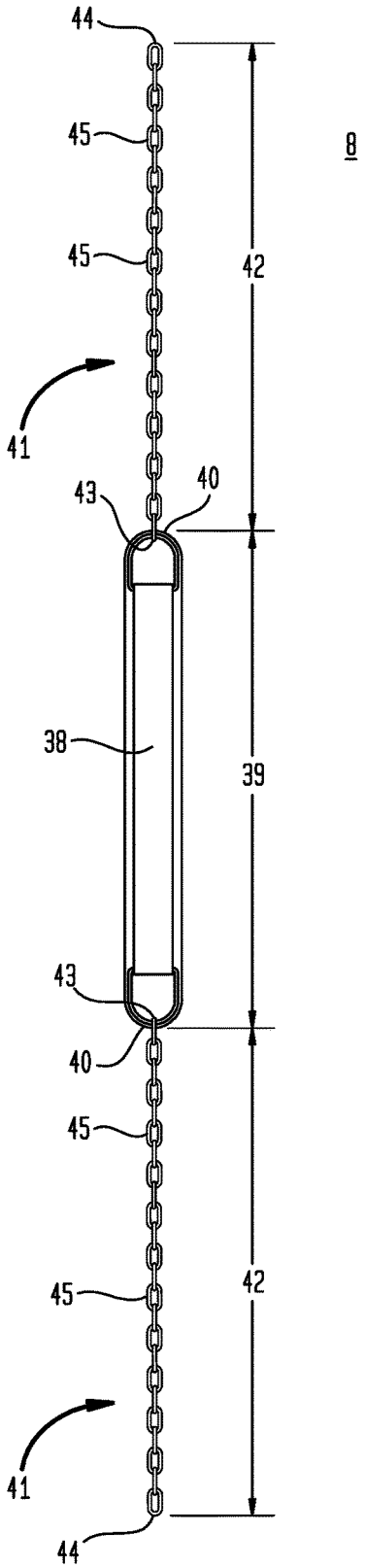
FIG. 9 is an unfurled view of a particular embodiment of a suspension element of the inventive suspension system.

Now referring primarily to FIG. 9, the flexible lower torso engagement portion (38) can have a flexible lower torso engagement portion length (39) disposed between opposing flexible lower torso engagement portion ends (40).

As to particular embodiments, each of the flexible lower torso engagement portion ends (40) can be directly coupled or connected to one of the second upright members (5) (not shown).

Additionally, as to particular embodiments, the flexible lower torso engagement portion length (39) can be adjustable between a lesser and greater length, which may be useful for accommodating a plurality of users (9) of varying dimensional relations or for generating forces on a portion of a spine of a user (9) to alleviate one or more disorder symptoms or to treat one or more disorders.

For example, adjusting the flexible lower torso engagement portion length (39) towards a lesser length can dispose the flexible lower torso engagement portion (38) a greater distance from the second upright members' lower ends (19) and, correspondingly, a greater distance from the support surface (10) which the second upright members (5) engage with, in relation to adjusting the flexible lower torso engagement portion length (39) towards a greater length, which can dispose the flexible lower torso engagement portion (38) a lesser distance from the second upright members' lower ends (19) and, correspondingly, a lesser distance from the support surface (10) which the second upright members (5) engage with.

As to other particular embodiments, each of the flexible lower torso engagement portion ends (40) can be coupled to one of the second upright members (5), for example by a coupler (41) (as shown in the examples of the Figures).

Figure 8:
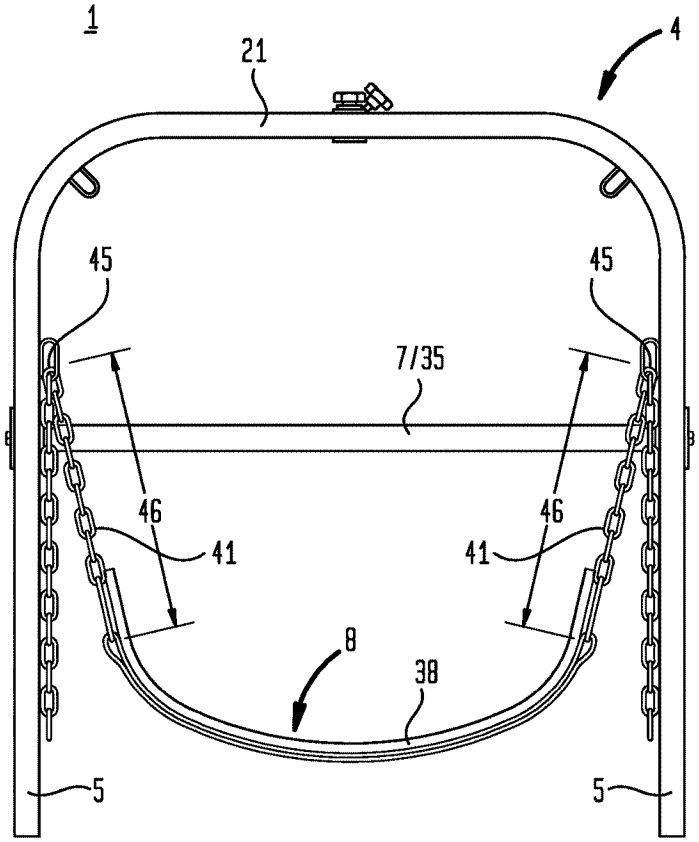
FIG. 8 is a second view of the particular embodiment of the inventive suspension system shown in FIG. 2A.
Figure 7:
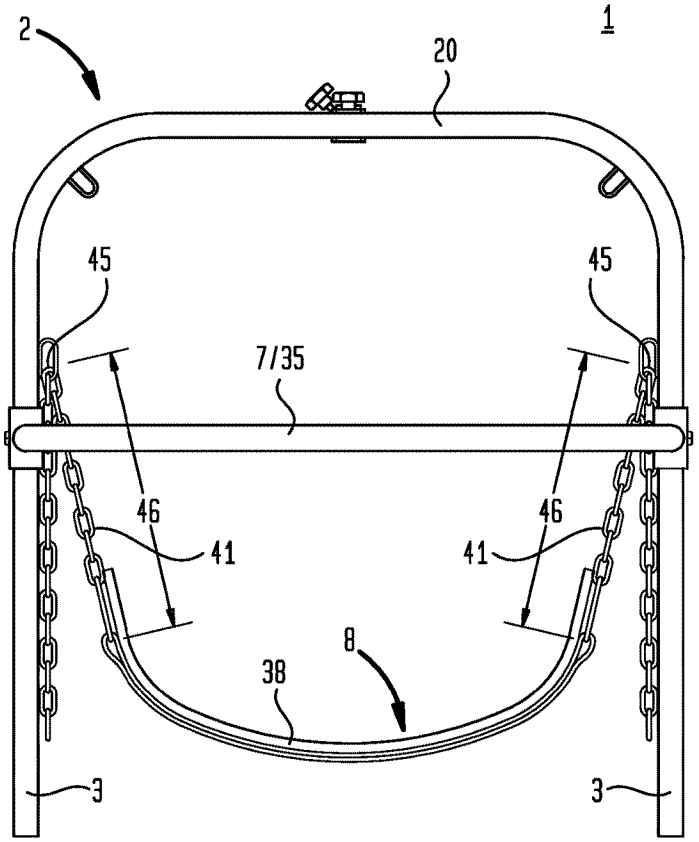
FIG. 7 is a first end view of the particular embodiment of the inventive suspension system shown in FIG. 2A.

Now referring primarily to FIG. 7 through FIG. 9, as an illustrative example, the coupler (41) can be configured as an elongate coupler (41) having an elongate coupler length (42) disposed between elongate coupler first and second ends (43)(44), whereby the elongate coupler first end (43) can couple, directly couple, or connect to one of the opposing flexible lower torso engagement portion ends (40).

A plurality of connection points (45), whether continuous or discrete, can be disposed along the elongate coupler length (42) distal from the elongate coupler first end (43) to provide an adjustable elongate coupler length (42), whereby each of the connection points (45) can couple, directly couple, or connect to one of the second upright members (5) to provide a second distance (46) between the flexible lower torso engagement portion end (40) and the corresponding second upright member (5).

Accordingly, the second distance (46) can be adjustable between a lesser and greater distance, which may be useful for accommodating a plurality of users (9) of varying dimensional relations or for generating forces on a portion of a spine of a user (9) to alleviate one or more disorder symptoms or to treat one or more disorders.

For example, adjusting the second distance (46) towards a lesser distance can dispose the flexible lower torso engagement portion (38) a greater distance from the second upright members' lower ends (19) and, correspondingly, a greater distance from the support surface (10) which the second upright members (5) engage with, in relation to adjusting the second distance (46) towards a greater distance, which can dispose the flexible lower torso engagement portion (38) a lesser distance from the second upright members' lower ends (19) and, correspondingly, a lesser distance from the support surface (10) which the second upright members (5) engage with.

As a non-limiting example, the elongate coupler (41) can be configured as a tether, such as a rope, cord, string, chain, or the like, or combinations thereof.

Now referring primarily to FIG. 1, the suspension system (1) can, but need not necessarily, further include a leg support (47) configured to support a leg portion (48) of a user (9) when using the suspension system (1). As to particular embodiments, the leg support (47) can be configured as a compressible leg support (47), such as a compressible sphere or ball.

A method of making the suspension system (1) can include providing a first support (2) comprising a pair of first upright members (3) disposed in spaced apart relation; providing a second support (4) comprising a pair of second upright members (5) disposed in spaced apart relation; disposing a transverse member (6) between the first and second supports (2)(4); disposing a grippable element (7) between the first upright members (3); and disposing a suspension element (8) between the second upright members (5).

The method of making the suspension system (1) can further include providing additional components of the suspension system (1), as detailed above.

Components of the suspension system (1) can be coupled, directly coupled, or connected to one another by an adherent layer, which can broadly encompass one or more of a wide variety of adhesives or mechanical fasteners as would be known to one of ordinary skill in the art.

As non-limiting examples, adhesives may include: welds generated from welding (which can join materials by causing coalescence), non-reactive adhesives including drying adhesives, pressure-sensitive adhesives, contact adhesives, and hot adhesives; reactive adhesives including one-part adhesives and multi-part adhesives; natural adhesives; synthetic adhesives; or the like, or combinations thereof.

As non-limiting examples, mechanical fasteners may include: bolts, clamps, clips, pins, nails, pegs, screws, staples, threaded fasteners, ties, or the like, or combinations thereof.

As can be easily understood from the foregoing, the basic concepts of the present invention may be embodied in a variety of ways. The invention involves numerous and varied embodiments of a suspension system, and methods for making and using such a suspension system, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the teen "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the suspension systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any U.S. patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A suspension system comprising:

a first support comprising a pair of first upright members disposed in generally parallel spaced apart relation;

a second support comprising a pair of second upright members disposed in generally parallel spaced apart relation;

wherein said pair of first upright members is dispose in generally parallel relation to said pair of second upright members;

said first support further comprises a first crosspiece disposed between said first upright members said second support further comprises a second crosspiece disposed between said second upright members;

a transverse member disposed centrally between said first crosspiece and said second crosspiece;

a grippable element directly coupled to said first upright members; and a suspension element directly coupled to said second upright members, said suspension element comprises a flexible lower torso engagement portion configured to sufficiently flex to conformingly engage a lower torso portion of a user to suspend said lower torso portion above a support surface.

2. The suspension system of claim 1, wherein:

each said first upright member has a first upright member length disposed between first upright member upper and lower ends;

each said second upright member has a second upright member length disposed between second upright member upper and lower ends; and said first and second upright member lengths are in a range of between about 0.5 meters to about 1.5 meters.

3. The suspension system of claim 2, wherein said first and second upright member lengths are adjustable.

4. The suspension system of claim 1, wherein:

said first crosspiece has a first crosspiece length disposed between first crosspiece first and second ends;

said second crosspiece has a second crosspiece length disposed between second crosspiece first and second ends; and said first and second crosspiece lengths are in a range of between about 0.5 meters to about 1.5 meters.

5. The suspension system of claim 4, wherein said first and second crosspiece lengths are adjustable.

6. The suspension system of claim 1, wherein said transverse member has a transverse member length disposed between opposing transverse member ends, said transverse member length in a range of between about 0.5 meters to about 2 meters.

7. The suspension system of claim 6, wherein said transverse member length is adjustable.

8. The suspension system of claim 1, wherein said grippable element has a grippable element length disposed between opposing grippable element ends, said grippable element length in a range of between about 0.5 meters to about 2 meters.

9. The suspension system of claim 8, wherein said grippable element length is adjustable.

10. The suspension system of claim 1, further comprising a leg support.

11. The suspension system of claim 10, wherein said leg support is configured as a compressible leg support.

12. The suspension system of claim 1, wherein:

said first support comprising said first crosspiece disposed between said first upright members is configured as a one-piece first support; and said second support comprising said second crosspiece disposed between said second upright members is configured as a one-piece second support.

13. The suspension system of claim 1, wherein said grippable element adjustably couples between said first upright members along a length of each said first upright member.

14. The suspension system of claim 1, wherein said grippable element is configured as a continuous grippable element which continuously extends between said first upright members.

15. The suspension system of claim 1, wherein said grippable element is configured as a pair of discontinuous grippable elements, each said discontinuous grippable element inwardly extending from one of said first upright members.

16. The suspension system of claim 1, wherein said grippable element comprises a grippable external surface element which allows the user to maintain a grip on said grippable element when using said suspension system.

17. The suspension system of claim 1, further comprising a cushioning element coupled to said flexible lower torso engagement portion.

* * * * *